US008082835B2

(12) United States Patent
Soukos

(10) Patent No.: US 8,082,835 B2
(45) Date of Patent: Dec. 27, 2011

(54) LIGHT WEIGHT ELECTRONIC PROTECTIVE SHIELD FROM ROCKET-PROPELLED GRENADES

(76) Inventor: Konstantinos Soukos, Larisa (GR)

( * ) Notice: Subject to any disclaimer, the term of this patent is extended or adjusted under 35 U.S.C. 154(b) by 39 days.

(21) Appl. No.: 12/449,635

(22) PCT Filed: Feb. 20, 2008

(86) PCT No.: PCT/GR2008/000012

§ 371 (c)(1),
(2), (4) Date: Aug. 18, 2009

(87) PCT Pub. No.: WO2008/102183

PCT Pub. Date: Aug. 28, 2008

(65) Prior Publication Data

US 2010/0224055 A1 Sep. 9, 2010

(30) Foreign Application Priority Data

Feb. 22, 2007 (GR) ..... 20070100114

(51) Int. Cl.
*F41H 5/00* (2006.01)

(52) U.S. Cl. ..... 89/36.01; 89/36.08; 89/1.11

(58) Field of Classification Search ..... 89/36.01, 89/36.08, 1.11, 36.17
See application file for complete search history.

(56) References Cited

U.S. PATENT DOCUMENTS

| | | | | |
|---|---|---|---|---|
| 5,519,963 | A | 5/1996 | Shih | 43/137 |
| 7,296,503 | B1 * | 11/2007 | McGrath | 89/1.13 |
| 7,827,900 | B2 * | 11/2010 | Beach et al. | 89/36.17 |
| 2010/0294124 | A1 * | 11/2010 | Wentzel | 89/36.02 |

FOREIGN PATENT DOCUMENTS

| | | |
|---|---|---|
| GR | 1005177 | 2/2006 |
| JP | 2002295996 | 10/2002 |
| RU | 2199711 | 2/2003 |
| WO | 2006135432 | 12/2006 |

* cited by examiner

*Primary Examiner* — J. Woodrow Eldred
(74) *Attorney, Agent, or Firm* — Adams & Wilks

(57) ABSTRACT

An electronic shield provides protection against rocket propelled grenades. The electronic shield has a mounting frame having opposite first and second mounting surfaces. Grids of electrodes are mounted in spaced-apart relation one behind the other on the first and second mounting surfaces of the mounting frame to form an impact surface configured to be impacted by a rocket propelled grenade. Each grid of electrodes has first connecting end portions connected directly to the first mounting surface of the mounting frame and second connecting end portions connected to the second mounting surface of the mounting frame via respective elastic members. During impact of a grenade on the impact surface, at least one electronic operation device instantaneously directs high power modulated electronic pulses to the impact surface to instantaneously deactivate the grenade.

24 Claims, 2 Drawing Sheets

LIGHT WEIGHT ELECTRONIC PROTECTIVE SHIELD FROM ROCKET-PROPELLED GRENADES

CROSS-REFERENCE TO RELATED APPLICATIONS

This application is a U.S. national stage application of International Application No. PCT/GR2008/000012 filed Feb. 20, 2008, claiming a priority date of Feb. 22, 2007, and published in a non-English language.

BACKGROUND OF THE INVENTION

1. Field of the Invention

The invention refers to a light weight electronic armour or shield that protects vehicles, helicopters or any other fixed or movable constructions from attacks with rocket-propelled grenades (RPGs). The protection of the abovementioned constructions is accomplished by the instantaneous electrical and mechanical destruction of all the grenades that hit the armour.

2. Background Information

RPG 7 rocket-propelled grenades consist of three main parts. A trigger mechanism, which is usually a piezoelectric crystal, the warhead containing the main explosive charge and the hollow charge, and the rocket that propels the grenade towards the target. Due to the simple construction of a rocket-propelled grenade there are many different models each with distinct technical characteristics and abilities.

Construction materials of such weapons are cheap and widely accessible, further reducing their cost and eventually making them accessible and particularly popular even in the poorest and most underdeveloped countries. Therefore, it is common for anyone wishing to cause death, damage and destruction to use these weapons.

The abovementioned grenades are initially launched through a launcher and then propelled to the target aided by the rocket for a distance ranging approximately to 300 m. At a distance from 50 to 110 meters from the exit of the launcher, grenades are exceptionally effective since they can reach their target and penetrate even 600 mm of armoured steel in certain cases. This potential classifies these weapons as exceptionally lethal.

Rocket-propelled grenades are low cost, low technology and easy-to-use man-portable weapons, used mainly against vehicles of all types, tanks and helicopters. They are very effective when used in operations in confined areas, e.g. within city limits, and this is why there are every day instances of destruction of targets with the use of such weapons.

SUMMARY OF THE INVENTION

This invention is aimed at creating a light electronic protective shield that can protect against and instantaneously destroy rocket propelled grenades of the RPG 7 type, except of grenades of the NADER or other similar to that type. At the same time, the protective shield is light-weight (up to 12 $kg/m^2$) so that its application and use is simple, is cost-effective and simple to construct, is durable so that it can sustain multiple hits, and its appearance is discrete so that it becomes difficult for the enemy to identify.

This invention refers to a light weight electronic shield, which protects all types of vehicles, tanks, helicopters or any other fixed and movable constructions from attacks by rocket propelled grenades, and includes multiple, and at least two, grids of electrodes forming a destruction or impact surface that is impacted by the grenade. Moreover it includes one exterior mounting frame which supports the grids of electrodes with the destruction surface, at least one electronic operation device and at least two plugs for connecting the grids of the electrodes with the electronic device. The electronic device is supplied by either 12 or 24 VDC from common batteries and directs instantaneously modulated electronic pulses resulting in the instantaneous destruction of the grenades during impact of the grenades on the shield.

In one exemplary embodiment, the present invention has three grids of electrodes.

The present invention is necessary for the protection, in a fast and convenient way, of various moving, static, self-propelled or remotely controlled objects, installations, military and civilian equipment, which become targets of hostile attacks. It is necessary for the instantaneous and safe destruction of lethal RPG 7 grenades of any type launched against targets requiring protection. Its light weight, its ability to adjust to various shapes and dimensions, and the effective operation thereof make this invention ideal for use in any application. In its more simplistic form, it can be a light protective shield, as described below in one exemplary embodiment.

The above results are accomplished by the following features of the present invention:

Firstly, one feature is that the active destruction surface has at least one grid of electrodes placed one after the other while keeping a distance between them, to in such a manner so that they do not touch each other and they are electrically insulated from each other, and simultaneously being in exact alignment. These grids have openings each with dimensions varying between 30 and 80 mm in height and 30 to 300 mm in length.

Secondly, another feature is in the special manner that the grids of the electrodes are attached on the mounting frame. Each grid of the electrodes is fixed on the mounting frame only from its one side, while the cross or opposite side from its fixed side is tied on the mounting frame with special elastic canals, thereby allowing it to move. All the other sides of the grid remain unfixed. The next (adjacent) grid is situated reversely, namely it is fixed on the mounting frame from the side that the previous was tied with the special elastic members or canals while it is tied with the special elastic canals from the side that the previous was fixed on the mounting frame. This arrangement is applied for all the grids used.

Thirdly, another feature is on the application of reversely polarized modulated electric signal in the adjacent grids of the electrodes through at least one electronic operation device. During the impact of one or more grenades on the shield's energetic surfaces, the device instantaneously directs modulated electronic pulses, which contribute to the destruction of the grenades.

The protective shield against rocket-propelled grenades, according to the present invention, holds many advantages.

The abovementioned shield does not use any explosives, chemical and toxic materials, laser, nuclear energy, and transmitted radio frequencies or other form of electromagnetic radiation to reach the desired outcome. The use thereof is safe and there is no risk of injury or death from the use thereof both for individuals inside the construction under protection and for individuals around it.

The operation of the protective shield of the present invention is supported by at least one high standards electronic operation device, which is connected through at least two plugs to the mounting frame, according to this invention. The operation of the shield is automated and does not require additional handling during its operation. Therefore, this invention is simple and easy to use and operate.

Having ensured the simple operation and function/handling of the protection system, according to this invention, total protection of human lives and tangibles protected by the electronic shield is provided against the highly destructive consequences of and casualties induced by RPG 7 rocket-propelled grenades, after they have collided with the desired target.

Provided that the operation of this invention is continuous, permanent protection of the target shielded by this invention is accomplished. Such targets can be vehicles, tanks, aircrafts, buildings, etc. This invention can also resist multiple hits from rocket-propelled grenades without losing the effectiveness thereof.

Furthermore, in the case that the openings of the grids are partially covered, the shield is transparent so that the individuals inside the construction protected by this shield e.g. vehicles, can see outside.

To further simplify the present invention, the design and construction thereof are such that enables the shield to acquire any shape and dimension, according to the application. The total weight of the shield, including the grids, the mounting frame and a layer of insulating or elastic material is very small and can reach 12 kg per $m^2$, thereby making it is possible to further decrease its weight.

The entire operation of the present invention is continuous and the effectiveness thereof is not affected by any external factor, since its compact and solid construction in combination with the high standard support thereof by at least one electronic support unit do not allow any intervention.

The simple and flexible design of the shield allows its easy and fast installation and removal from the construction to be protected, without necessitating specialised and numerous personnel.

DETAILED DESCRIPTION OF THE PREFERRED EMBODIMENT

The construction and the way of operation of the present invention, along with its applications and advantages, will be more tangible with the following description with the help of the figures, which reflect the shield of the present invention with three grids of electrodes (1, 2, 3), that create a bronch (bronchus) or loop, the number of electrodes (1, 2, 3) in the figures are only provided as an-example.

Figure 1:
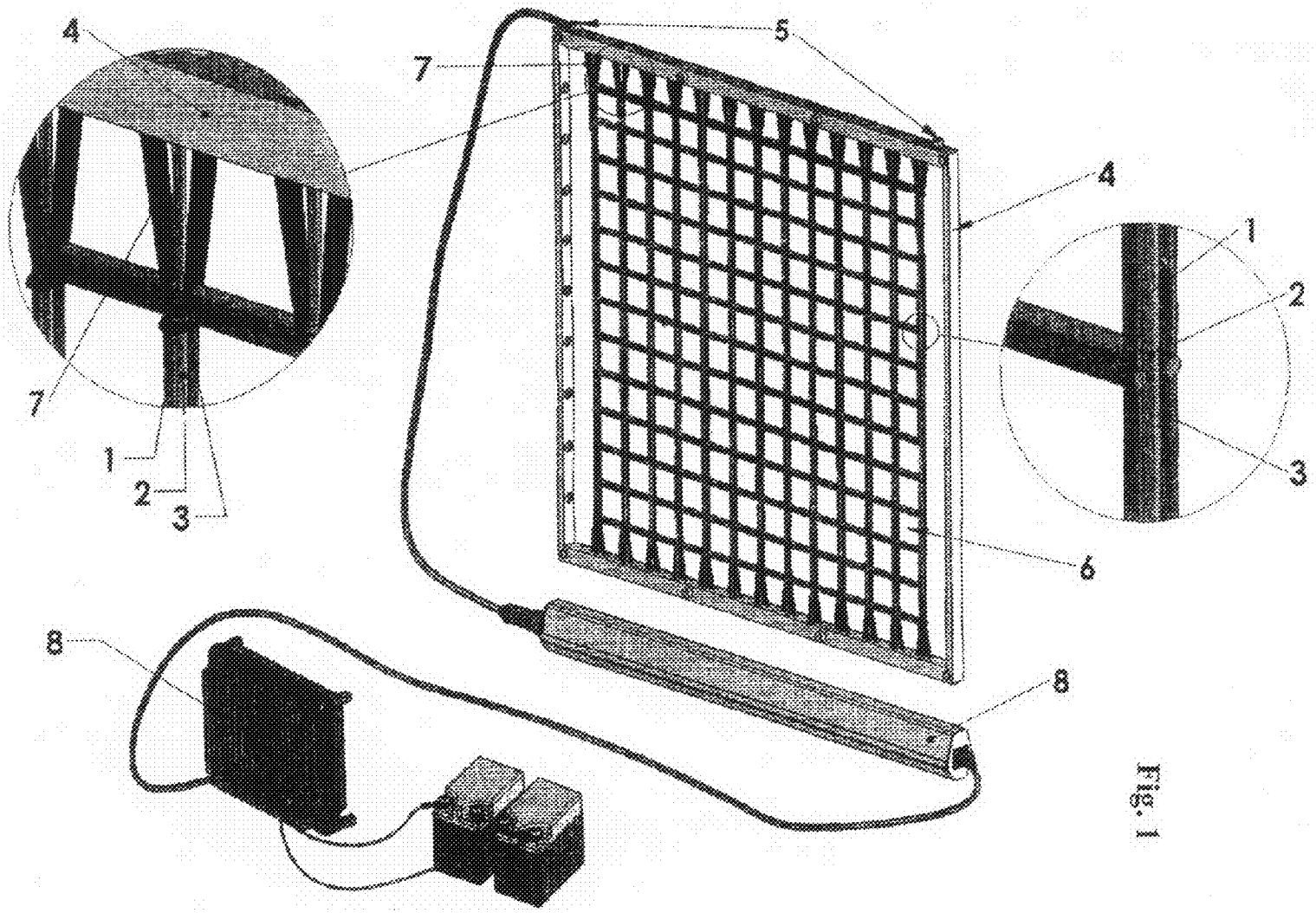
FIG. 1 is a perspective view of the electronic protective shield according to the present invention.

FIG. 1 illustrates a perspective view of the protective shield against rocket-propelled grenades, according to the present invention, consisting of three grid of electrodes (1, 2, 3), only as an example, and the mounting frame (4). Each grid of electrodes (1, 2, 3) is firmly fixed on the mounting frame (4), only from one side, while it is tightened with special non-conductive elastic members or canals (7) on the mounting frame (4) from the opposite site. The mounting frame (4) has two plugs (5) that connect the electrodes (1, 2, 3) to the electronic device (8), which is supplied by either 12 or 24 VDC from common batteries. During impact of the grenades on the shield, as described below, the electronic device 8 directs instantaneously modulated electronic pulses resulting in the instantaneous destruction of the grenades.

Figure 2:
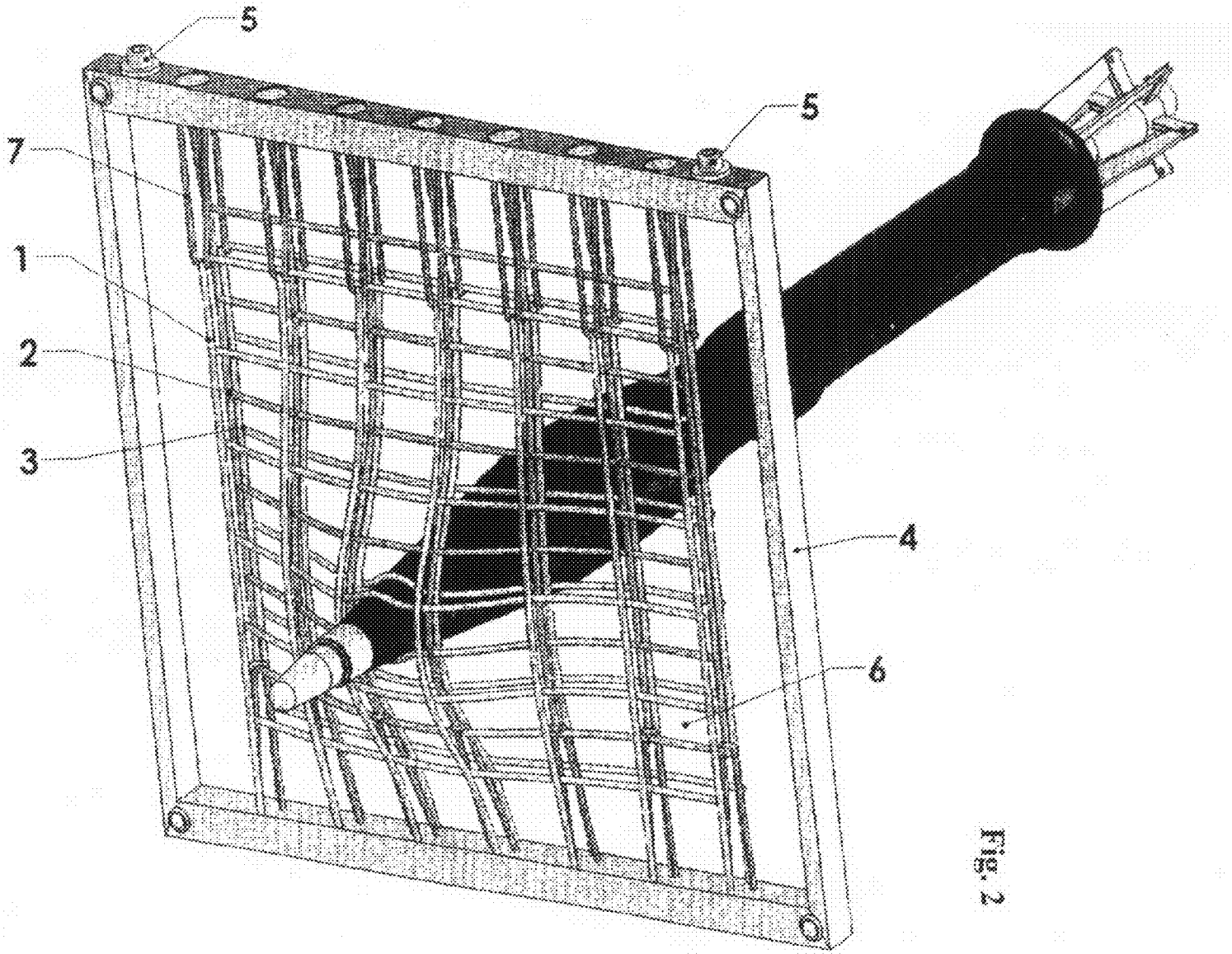
FIG. 2 is another perspective view of the electronic protective shield according to the present invention illustrating the instant in which a grenade enters the protective shield.

FIG. 2 illustrates a perspective view of the protective shield from rocket propelled grenades, according to the present invention, at the instant that a bronch is created by the adjacent grid of electrodes (1, 2, 3) when the grenade enters in the protective shield.

The mounting frame (4) is necessary for the mounting of the destruction surfaces on it so as to achieve the desired form and operation, moreover it is necessary for the installation of the shield in place where a particular construction is to be protected.

FIG. 1 illustrates how each grid of electrodes (1, 2, 3) is attached on the mounting frame (4) in such a way as to have its one side firmly fixed on the frame (4) while its opposite side is not in contact with the frame (4) and is tightened with the elastic non-conductive canals (7), thereby allowing each grid (1, 2, 3) to move in a particular distance in relation to the frame (4).

The mounting frame (4) is manufactured, preferably, with materials like metal or metallic alloys or synthetic materials (e.g., carbon fibers or high strength polyethylene multifilament yarns, such as Dyneema®) of high endurance and has adequate thickness so it can support the grids of the electrodes (1, 2, 3). This mounting frame (4) constitutes the supporting fixture for all the grids of electrodes (1, 2, 3) that are used.

Each grid of electrodes (1, 2, 3) is manufactured with a material of high breaking force and flexibility with low weight, so as not to be destroyed while the grenade hits the shield, so that the grenade enters the grids (1, 2, 3), that create a bronch at that instant and strangles the grenade. The grids (1, 2, 3) can have cross section of from 2 to 10 mm.

The grids of the electrodes (1, 2, 3) are placed in a consecutive manner so as not to be in contact with one another and their openings (6) are in total alignment. Each of the openings (6) of the grids (1, 2, 3) can have a width of from 30 to 80 mm and a length of from 30 to 300 mm.

Each grid of electrodes (1, 2, 3) is firmly fixed on one side of the mounting frame (4), so that its adjacent grid (1, 2, 3) is firmly fixed on the opposite, parallel side of the frame (4).

The grids of the electrodes (1, 2, 3) are attached on the sides of the frame (4) in a particular way, which is described analytically below. The grids (1, 2, 3) are attached in such a way so as to have opposite polarity successively.

In order to firmly fix the grids of electrodes (1, 2, 3) on the sides of the frame (4), each side of the frame (4) has holes coated with insulators. These holes are situated in particular distances between them along every side of the frame (4), so that the electrodes can pass through them and create the grid (1, 2, 3).

All the grids of the electrodes (1, 2, 3) can be covered with whichever insulating or plastic material, as long as it is easy to be perforated, which can cover the total thickness of the frame (4), with the possibility of partial or complete covering of the openings (6) of the grids (1, 2, 3) according to the application.

On the mounting frame (4), in appropriate positions, two plugs (5) are placed so as to enable the connection of the grids of electrodes (1, 2, 3) with the electronic device (8) (or devices in case we have more than one). The operation of the system can be accomplished with the use of a plug connector.

The electronic operation device (8) supplies momentarily modulated electronic pulses of high intensity in all the grids of electrodes (1, 2, 3), in such a way so that the grids (1, 2, 3) have different polarity successively, for that reason the grids (1, 2, 3) are electrically insulated with each other.

The reverse polarity of the grids (1, 2, 3) has as a result the instant that the grenade impacts and enters the openings (6) of the grids (1, 2, 3), that form a bronch, to create a short circuit on the metallic surface of the grenade and at the same time the electronic device (8) directs instantaneously electronic pulses of very high intensity at the points where the grenade touches the grids (1, 2, 3). This results in the tempering of the metallic surface of the grenade on the points of contact with the electric charged grids of electrodes (1, 2, 3) and the destruction of the conductors that carry the detonation signal from the piezoelectric crystal to the detonation mechanism resulting in the prevention of the detonation of the hollow charge of the grenade.

FIG. 2 illustrates the method of attaching the grids of electrodes (1, 2, 3) on the supporting frame (4), as it is described above, and also illustrates how this method permits each grid (1, 2, 3) to have a degree of elasticity and, because of the fact that the sequential grids (1, 2, 3) have apposite sides of fixation on the frame (4), permits the grids to move in the opposite direction when the incoming grenade enters the openings (6) of the grids (1, 2, 3) creating a bronch. The momentum of the grenade during its entrance through the openings (6) of the grids (1, 2, 3) forces the grids (1, 2, 3) to move towards opposite directions resulting in the development of opposite forces on the metallic ogive of the grenade. These opposite forces are applied on the contact points of the grenade with the grids of the electrodes (1, 2, 3) and result in the choking or strangulation of the grenade.

These forces are applied on the spot of the metallic ogive of the grenade, which has been tempered, because it is in contact with the opposite polarized grids of electrodes (1, 2, 3) at the same instant, as a result the grenade breaks in these spots. Consequently, the destruction of the main body of the grenades is achieved and in extension the destruction of the hollow charge and the conductors that transfer the detonation command, retaining in parallel untouched the piezoelectric crystal, which is situated in the front tip of the grenade, before the detonation command of the hollow charge is given.

The invention claimed is:

1. A light weight electronic shield for protecting against rocket propelled grenades, comprising:

a mounting frame;

at least two grids of electrodes having a plurality of openings and defining an impact surface configured to be impacted by a rocket propelled grenade, each of the at least two grids of electrodes having a plurality of sides with only two opposite sides of the plurality of sides being connected to respective two opposite sides of the mounting frame so that the at least two grids of electrodes are supported by the mounting frame in spaced-apart relation to one another with the openings of one of the at least two grids of electrodes being disposed in complete alignment with the respective openings of the other of the at least two grids of electrodes, one of the opposite sides of the one of the at least two grids of electrodes being connected directly to one of the two opposite sides of the frame and the other of the opposite sides of the one of the at least two grids of electrodes being connected to the other of the two opposite sides of the frame via an elastic member, and one of the opposite sides of the other of the at least two grids of electrodes being connected directly to the other of the two opposite sides of the frame and the other of the opposite sides of the other of the at least two grids of electrodes being connected via an elastic member to the one of the two opposite sides of the frame; and at least one electronic operation device that, during impact of a grenade on the impact surface of the at least two grids of electrodes, instantaneously directs high power modulated electronic pulses to the impact surface to instantaneously destroy the grenade.

2. A light weight electronic shield according to claim 1; wherein each of the openings of the at least two grids of electrodes has a height in the range of 30 to 80 mm and a width in the range of 30 to 300 mm configured, on one hand, to permit a front portion of a grenade comprised of a metallic ogive section having a piezoelectric crystal to enter into the opening and simultaneously contact the at least two grids of electrodes and, on another hand, to achieve destruction of a main body or other part of the grenade having a cross-section greater than that defined by the height and width of each opening.

3. A light weight electronic shield according to claim 2; wherein the electronic operation device is connected to the at least two grids of electrodes so that when the grenade impacts the impact surface of the at least two grids of electrodes and the metallic ogive section simultaneously contacts the at least to grids of electrodes, the electronic operation device instantly directs the high power modulated electronic pulses to the point of contact between the metallic ogive section of the grenade and the at least to grids of electrodes which, due to the reverse polarity of the at least two grids of electrodes, causes a short circuit on at least the metallic ogive of the grenade that results in the destruction of conductors of the grenade that carry detonation signals from the piezoelectric crystal to a detonation mechanism of the grenade resulting in the prevention of the detonation of a hollow charge of the grenade.

4. A light weight electronic shield according to claim 2; wherein the at least two grids of electrodes are reversely polarized from each other.

5. A light weight electronic shield according to claim 4; wherein the electronic operation device is connected to the at least two grids of electrodes so that when the grenade impacts the impact surface of the at least two grids of electrodes and the metallic ogive section simultaneously contacts the at least to grids of electrodes, the electronic operation device instantly directs the high power modulated electronic pulses to the point of contact between the metallic ogive section of the grenade and the at least to grids of electrodes which, due to the reverse polarity of the at least two grids of electrodes, causes a short circuit on at least the metallic ogive of the grenade that results in the destruction of conductors of the grenade that carry detonation signals from the piezoelectric crystal to a detonation mechanism of the grenade resulting in the prevention of the detonation of a hollow charge of the grenade.

6. A light weight electronic shield according to claim 5; wherein the electronic operation device instantly directs the high power modulated electronic pulses with a pulse power of 16 kW.

7. A light weight electronic shield according to claim 5; wherein the opposite sides of each of the at least two grids of electrodes are connected to the respective opposite sides of the mounting frame so that while the grenade impacts the impact surface and the metallic ogive section of the grenade enters one of the openings, the at least two grids of electrodes are forced into movement in opposite directions relative one another such that the electrodes corresponding to the opening through which the ogive section enters form a bronchus or loop around the metallic ogive section.

8. A light weight electronic shield according to claim 7; wherein each of the at least two grids of electrodes is made of a low-weight material having a high breaking force and flexibility that, on one hand, is not destroyed while the grenade impacts the impact surface and, on another hand, permits the metallic ogive section of the grenade to enter one of the openings and force the at least two grids of electrodes into movement in the opposite directions relative one another to form the bronchus or loop around the metallic ogive section.

9. A light weight electronic shield according to claim 8; wherein each of the at least two grids of electrodes comprises a plurality of grid lines forming the grid of electrodes; and wherein each grid line of each of the at least two grids of electrodes has a diameter in the range of 2 mm to 10 mm.

10. A light weight electronic shield according to claim 7; further comprising a layer disposed over the impact surface of the at least to grids of electrodes so as to at least partially cover the openings of the at least two grids of electrodes, the layer being made of a insulating or plastic material that is penetrable by the metallic ogive section of the grenade during impact of the impact surface to permit formation of the bronchus or loop without activating the grenade.

11. A light weight electronic shield according to claim 1; wherein the mounting frame is made of a metal or a metallic alloy and has a thickness sufficient for supporting the at least two grids of electrodes.

12. A light weight electronic shield according to claim 1; wherein the electronic shield is configured of a dimension and shape capable of protecting armored or non-armored vehicles, airplanes or ships, or any static or mobile installation or construction.

13. A light weight electronic shield according to claim 1; wherein the at least two grids of electrodes are reversely polarized from each other.

14. A light weight electronic shield according to claim 1; wherein the mounting frame is made of a high-strength synthetic material and has a thickness sufficient for supporting the at least two grids of electrodes.

15. A light weight electronic shield according to claim 14; wherein the high strength synthetic material comprises carbon fibers and/or high strength polyethylene multifilament yarn.

16. An electronic shield for protecting against rocket propelled grenades, comprising:

a mounting frame having opposite first and second mounting surfaces;

a plurality of grids of electrodes mounted in spaced-apart relation one behind the other on the first and second mounting surfaces of the mounting frame to form an impact surface configured to be impacted by a rocket propelled grenade, each grid of electrodes having first connecting end portions connected directly to the first mounting surface of the mounting frame and second connecting end portions connected to the second mounting surface of the mounting frame via respective elastic members; and at least one electronic operation device that, during impact of a grenade on the impact surface, instantaneously directs high power modulated electronic pulses to the impact surface to instantaneously deactivate the grenade.

17. An electronic shield according to claim 16; wherein each of the grids of electrodes comprises a set of intersecting grid lines having the first and second connecting end portions and forming a plurality of openings disposed in alignment with the respective openings of each of the other of the grids of electrodes.

18. An electronic shield according to claim 17; wherein the plurality of grids of electrodes comprises at least first and second grids of electrodes; wherein for each grid line of the first grid of electrodes, the first connecting end portion is connected directly to the first mounting surface of the mounting frame and the second connecting end portion is connected to the second mounting surface of the mounting frame via the elastic member; and wherein for each grid line of the second grid of electrodes, the first connecting end portion is connected to the first mounting surface of the mounting frame via the elastic member and the second connecting end portion is connected directly to the second mounting surface of the mounting frame.

19. An electronic shield according to claim 18; wherein the plurality of grids of electrodes comprises a third grid of electrodes mounted on the first and second mounting surfaces of the mounting frame in spaced-apart relation and one behind the other relative to the first and second grids of electrodes to form the impact surface together with the first and second grids of electrodes, the third grid of electrodes having first connecting end portions connected directly to the first mounting surface of the mounting frame and second connecting end portions connected to the second mounting surface of the mounting frame via respective elastic members; and wherein the third grid of electrodes comprises a set of intersecting grid lines having the first and second connecting end portions and forming a plurality of openings disposed in alignment with the respective openings of each of the first and second grids of electrodes.

20. An electronic shield according to claim 19; wherein the second grid of electrodes is disposed between the first and third grids of electrodes; and wherein for each grid line of the third grid of electrodes, the first connecting end portion is connected directly to the first mounting surface of the mounting frame and the second connecting end portion is connected to the second mounting surface of the mounting frame via the elastic member.

21. An electronic shield according to claim 17; wherein each opening of each grid of electrodes has a height in the range of 30 to 80 mm and a width in the range of 30 to 300 mm configured, on one hand, to permit a front portion of a grenade comprised of a metallic ogive section having a piezoelectric crystal to enter into the opening and simultaneously contact each grid of electrodes and, on another hand, to achieve destruction of a main body or other part of the grenade having a cross-section greater than that defined by the height and width of each opening.

22. An electronic shield according to claim 21; wherein the grids of electrodes are reversely polarized from each other.

23. An electronic shield according to claim 22; wherein the electronic operation device is connected to the grids of electrodes so that when the grenade impacts the impact surface of the grids of electrodes and the metallic ogive section simultaneously contacts the grids of electrodes, the electronic operation device instantly directs the high power modulated electronic pulses to the point of contact between the metallic ogive section of the grenade and the grids of electrodes which, due to the reverse polarity of the grids of electrodes, causes a short circuit on at least the metallic ogive of the grenade that results in the destruction of conductors of the grenade that carry detonation signals from the piezoelectric crystal to a detonation mechanism of the grenade resulting in the prevention of the detonation of a hollow charge of the grenade.

24. An electronic shield according to claim 23; wherein the grids of electrodes are mounted on the first and second mounting surfaces of the mounting frame so that while the grenade impacts the impact surface and the metallic ogive section of the grenade enters one of the openings, the grids of electrodes are forced into movement in opposite directions relative one another such that the electrodes corresponding to the opening through which the ogive section enters form a bronchus or loop around the metallic ogive section.

* * * * *